US007055874B1

(12) United States Patent
Jeffries et al.

(10) Patent No.: US 7,055,874 B1
(45) Date of Patent: Jun. 6, 2006

(54) DOOR HANDLE BRACKET AND LATCH ASSEMBLY

(75) Inventors: Mark Steven Jeffries, Cumming, GA (US); Marvin Lee Larsen, New Hampton, IA (US); Tobias J. Schwickerath, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/369,282

(22) Filed: Feb. 19, 2003

(51) Int. Cl.
*E05B 9/00* (2006.01)

(52) U.S. Cl. ..... 292/337; 292/215; 292/DIG. 64; 70/208

(58) Field of Classification Search ..... 292/337, 292/DIG. 64, 216, 346, 1; 70/208
See application file for complete search history.

(56) References Cited

U.S. PATENT DOCUMENTS 3,400,962 A * 9/1968 Martens ..... 292/216
3,622,188 A * 11/1971 Goeman ..... 292/216
3,857,594 A 12/1974 Pastva, Jr.
4,202,571 A * 5/1980 Nishikoori ..... 292/216
D316,365 S 4/1991 Hansen et al.
D316,366 S 4/1991 Hansen et al.
D317,398 S 6/1991 Hansen et al.
D318,007 S 7/1991 Hansen et al.
5,042,853 A * 8/1991 Gleason et al. ..... 292/126
5,069,491 A * 12/1991 Weinerman et al. ..... 292/48
5,127,686 A * 7/1992 Gleason et al. ..... 292/216
5,171,048 A 12/1992 Weinerman et al.
5,192,096 A 3/1993 Weinerman et al.
5,193,861 A 3/1993 Juga et al.
5,209,530 A 5/1993 Kolloch
5,941,104 A * 8/1999 Sadler ..... 70/208
5,984,383 A * 11/1999 Parikh et al. ..... 292/121
6,048,003 A * 4/2000 Shimura ..... 292/216
6,109,670 A * 8/2000 Tomaszewski et al. ..... 292/216
6,454,321 B1 * 9/2002 Parikh ..... 292/216
6,494,506 B1 * 12/2002 Gleason et al. ..... 292/216
6,499,776 B1 * 12/2002 Takamura ..... 292/201

* cited by examiner

*Primary Examiner*—Gary Estremsky
(74) *Attorney, Agent, or Firm*—McKee, Voorhees & Sease, P.L.C.

(57) ABSTRACT

The door handle bracket and latch assembly of the present invention includes a bracket subassembly and a latch. The latch has a spring mounted rotor and a spring mounted catch which function to maintain a door in a latched or unlatched condition. The bracket subassembly includes a mounting plate, a pivotally mounted trip lever, and a rotational release cam receiving the drive shaft of the door handle. Upon rotation of the door handle in either a clockwise or counterclockwise direction, the release cam pivots the trip lever, which in turn pivots the catch out of retentive engagement with the rotor, such that the rotor rotates to the unlatched position to allow the door to move from the latched closed position to an unlatched open position. The assembly has a simple design with a low profile and versatile mounting options.

56 Claims, 8 Drawing Sheets

DOOR HANDLE BRACKET AND LATCH ASSEMBLY

BACKGROUND OF THE INVENTION

Door handle bracket and latch assemblies for various types of vehicle doors, such as compartment doors on fire trucks, ambulances, and RV's, typically have a complex design with numerous components. The complexity of the assemblies results in a product that is relatively bulky and precludes use in certain applications with space limitations.

Existing art requires installation from the inside and outside of the door, necessitating access from the inside of the door with special access cutouts and covers or assembling inner supporting structure after latch installation. Furthermore, the versatility of the assembly is usually limited so that each application requires a different design.

Therefore, a primary objective of the present invention is the provision of an improved door handle bracket and latch assembly.

Another objective of the present invention is the provision of a door handle bracket and latch assembly having a simple design.

A further objective of the present invention is the provision of a door handle bracket and latch assembly having a low profile for use in applications having restricted space limitations.

Another objective of the present invention is the provision for installation from the outside of the door to eliminate the need for special access cutouts, or assembly of inner supporting structure after latch assembly.

Another objective of the present invention is the provision of a door handle bracket and latch assembly with mounting versatility for different applications and orientations.

Still another objective of the present invention is the provision of a door handle bracket and latch assembly which can be connected to the door handle so that rotation of the handle in either a clockwise or counterclockwise direction will release the door latch.

A further objective of the present invention is the provision of a door handle bracket and latch assembly which can be mounted using bolts or screws extending through either the door handle pan or door handle flange.

Another objective of the present invention is the provision of a door handle bracket and latch assembly which can be utilized with either a locking or nonlocking door handle.

Still another objective of the present invention is the provision of a door handle bracket and latch assembly which is prevented from rotation relative to the door panel.

A further objective of the present invention is the provision of a door handle bracket and latch assembly which can be utilized on door panels having various thicknesses.

Yet another objective of the present invention is the provision of a door handle bracket and latch assembly which can be mounted into the door panel in different configurations.

Another objective of the present invention is the provision of a door handle bracket and latch assembly which precludes latch binding from deflection due to mounting torque.

A further objective of the present invention is the provision of a door handle bracket and latch assembly including a low coefficient plastic material release cam so as to provide low operating efforts.

Another objective of the present invention is the provision of an improved door handle bracket and latch assembly which is economical to manufacture and durable in use.

These and other objectives will become apparent from the following description of the invention.

SUMMARY OF THE INVENTION

The door handle bracket and latch assembly of the present invention includes a latch and a bracket subassembly. The latch has a rotor and a catch adapted to move between latched and unlatched positions. The bracket subassembly has a mounting bracket secured to the latch, a release cam rotatively mounted on the bracket subassembly, and a trip lever pivotally mounted on the bracket subassembly to trip the catch and thereby release the latch when the cam is actuated. The small number of components for the bracket subassembly allows the components to be assembled with only one machine operation. The assembly has a low profile due, in part, to the open design of the bracket wherein the cam is enclosed only on one side. The bracket subassembly has a plurality of mounting holes to allow multiple mounting options, such as through the door handle pan or flange.

DETAILED DESCRIPTION OF THE PREFERRED EMBODIMENT

Figure 1:
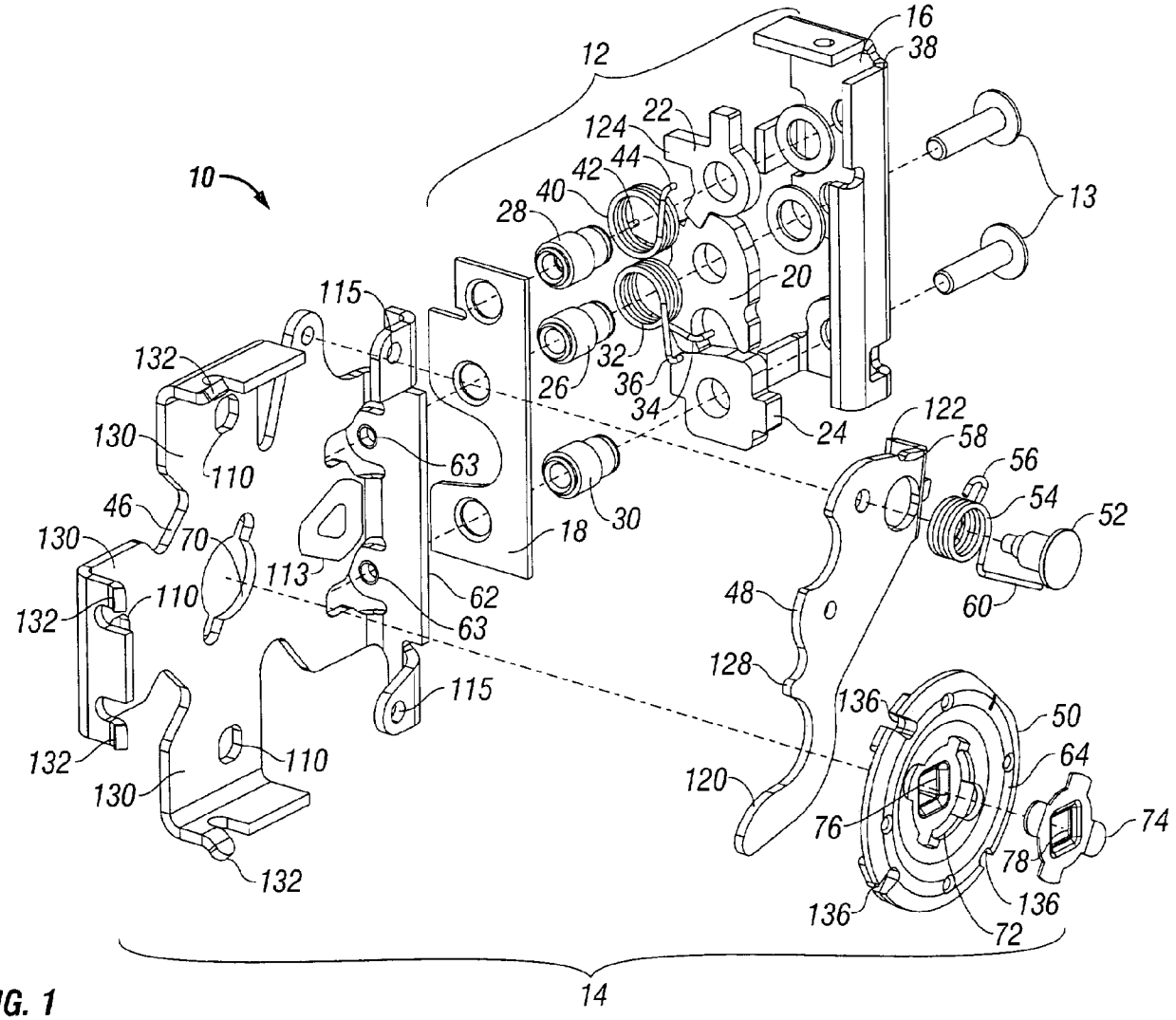
FIG. 1 is an exploded perspective view of the door handle bracket and latch assembly of the present invention.
Figure 2:
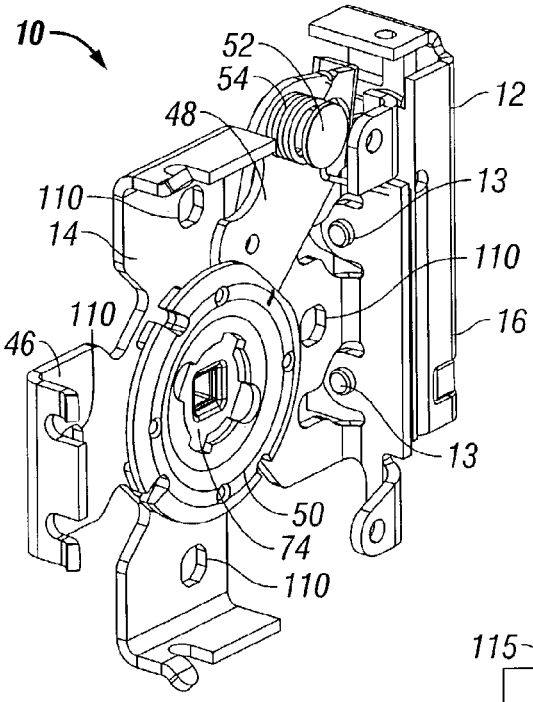
FIG. 2 is a perspective view of the door handle bracket and latch assembly.

The door handle bracket and latch assembly of the present invention is generally designated in the drawings by the reference numeral 10. The assembly includes a latch 12 and a bracket subassembly 14 secured together with bolts 13.

The latch 12 includes a front plate 16 and a back plate 18. The latch 12 further includes a rotor 20, a catch 22, and a strike 24 sandwiched between the front and back plates 16, 18. The rotor 20 is pivotally mounted on a rotor axle 26. The catch 22 is pivotally mounted upon a catch axle 28. The strike 24 is pivotally mounted on a strike axle 30. The rotor 20 is movable between a latched and unlatched position, and is biased to the unlatched position by a rotor spring 32 mounted on the rotor axle 26. One end 34 of the rotor spring 32 engages the rotor 20, while the opposite end 36 of the rotor spring 32 engages the inside of an upstanding wall 38 of the front latch plate 16. The catch 22 is pivotal between a locked and unlocked position, and is biased towards the locked position by a catch spring 40 mounted on the catch axle 28. One end 42 of the catch spring 40 engages the catch 22, while the other end 44 of the catch spring 40 engages the wall 38 of the front latch plate 16.

The bracket subassembly 14 includes a mounting plate 46, a trip lever 48, and a release cam 50. The trip lever 48 is pivotally mounted on the plate 46 by a rivet 52. The lever 48 is pivotal between latched and unlatched positions, and is biased to the latched position by a lever spring 54 mounted on the rivet 52. One end 56 of the lever spring 54 is retained in a notch 58 in the lever 48, while the opposite end 60 of the lever spring 54 engages the upturned mounting flange 62 of the bracket plate 46. The flange 62 includes threaded holes 63 for the bolts 13. The single rivet 52 simplifies the assembly process for the bracket 14.

Figure 4:
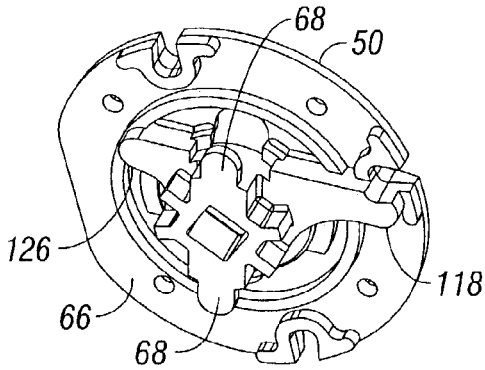
FIG. 4 is a perspective view of the release cam of the bracket.

The release cam 50 is preferably made from a low coefficient plastic material. The cam 50 includes a front face 64 and a rear face 66. As best seen in FIG. 4, the rear face 66 of the cam 50 includes a pair of retaining tabs 68. The tabs 68 are adapted to extend through a keyed opening 70 in the plate 46. The cam 50 is then rotated approximately 90° so that the tabs 64 retain the cam 50 on the bracket plate 46.

The front face 64 of the cam 50 includes a recess 72 adapted to receive a drive washer 74 with a friction or press fit. The cam 64 and drive washer 74 include aligned square holes 76, 78 respectively adapted to receive a square drive shaft 80 of a handle 82.

Figure 5:
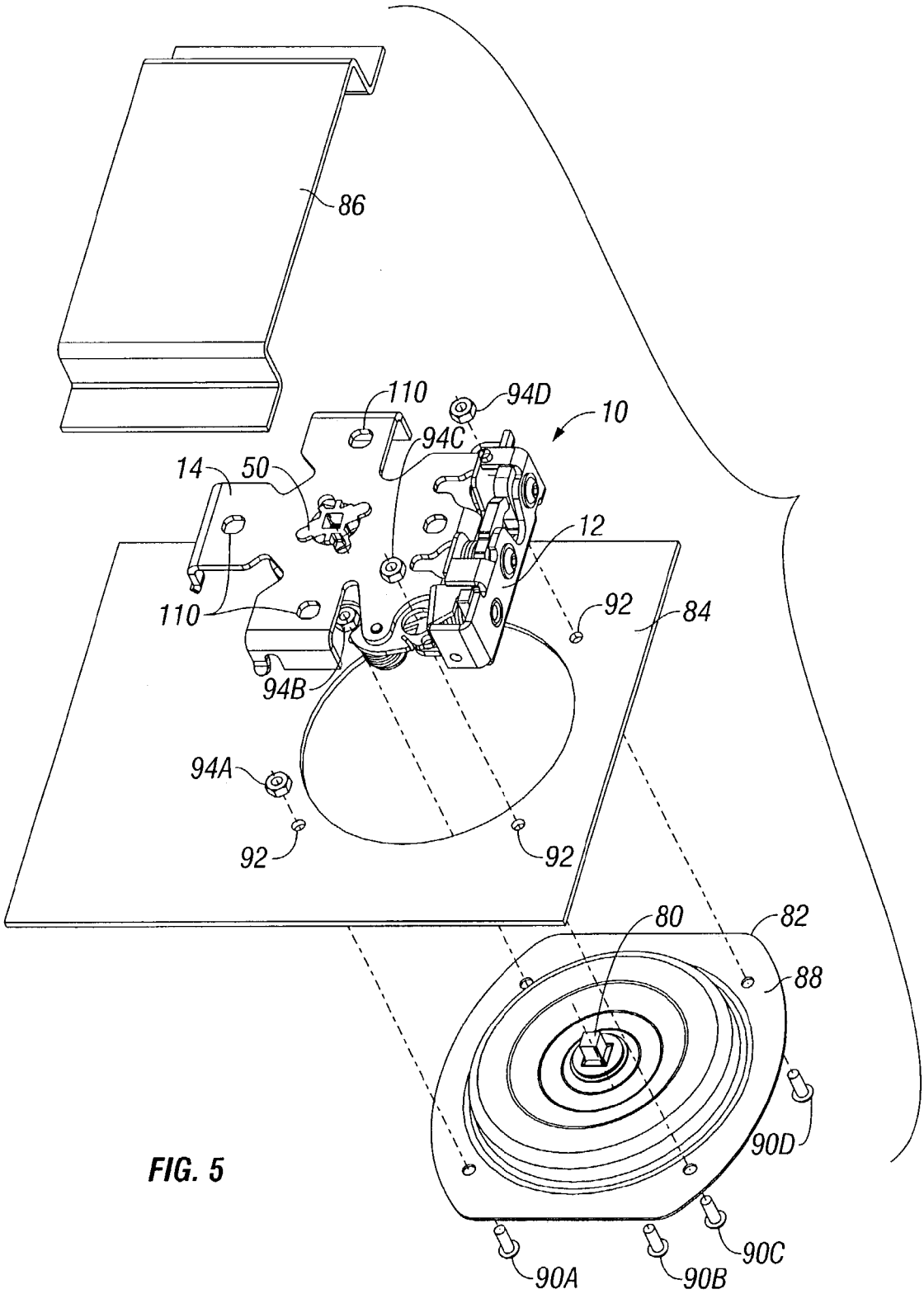
FIG. 5 is an exploded view of the assembly in a door panel with a door handle, and the mounting bolts extending through the flange of the door handle.
Figure 6:
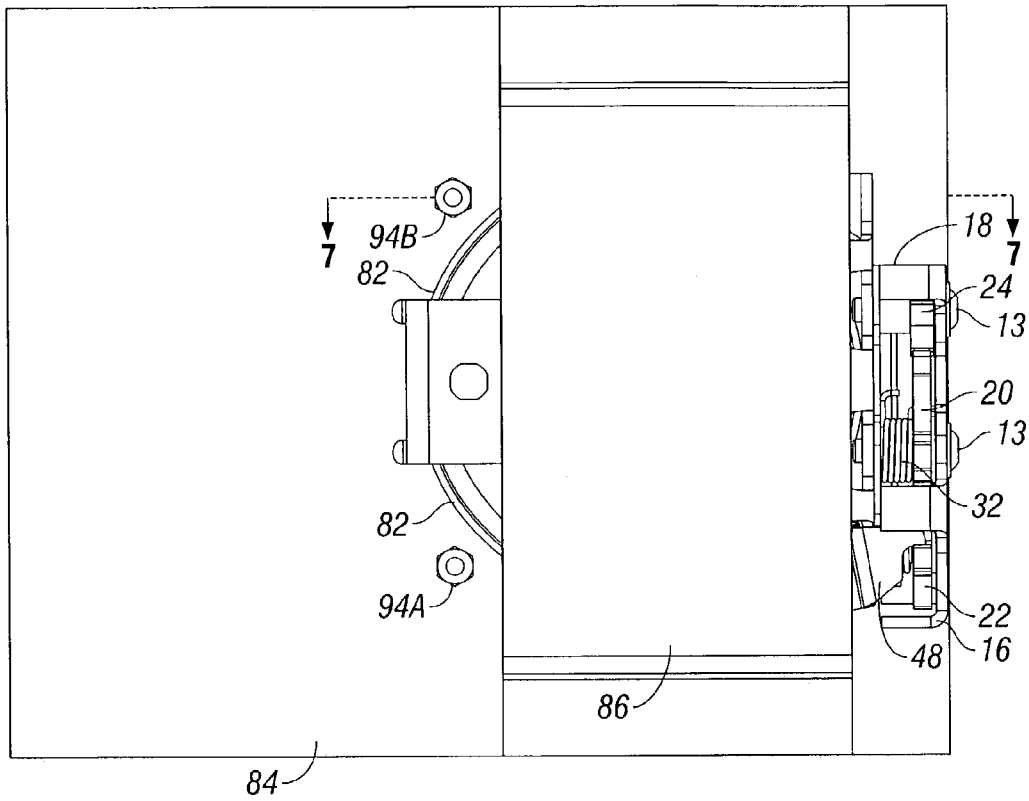
FIG. 6 is a plan view of the assembled component of FIG. 5.
Figure 7:
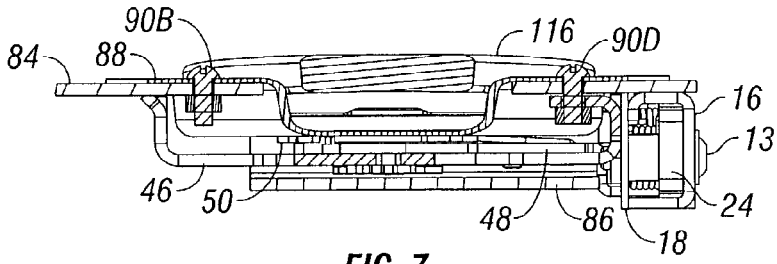
FIG. 7 is a sectional view through lines 7—7 of FIG. 6.

FIGS. 5–7 show one alternative for installing the bracket and latch assembly 10 to a door panel 84. The door panel 84 typically includes a support member 86 which is riveted or welded to the door panel 84 for structural support, either before or after the assembly 10 is installed. The relatively narrow space between the panel 84 and the support 86 requires that the assembly 10 have a low profile. As best seen in FIG. 5, the door handle 82 includes a flange through which mounting bolts 90 extend. Bolts 90A and 90B extend through aligned holes 92 and are secured with nuts 94A and 94B. Bolts 90C and 90D also extend through aligned holes 92 in the door panel 84, and further extend through corresponding holes in the bracket plate 46, and are secured with nuts 94C and 94D.

Figure 14:
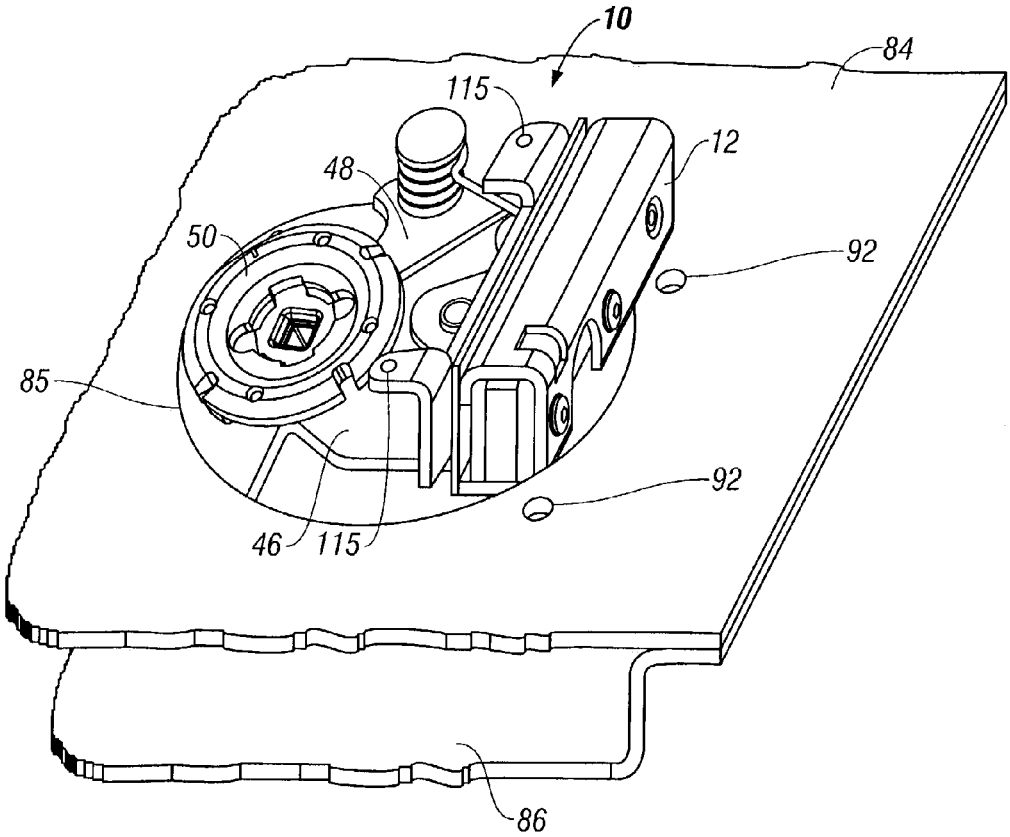
FIG. 14 is a perspective view showing the latch and bracket assembly being installed from a front side of a door.

If the support member 86 is fixed to the panel 84 before the assembly 10 is installed from the rear of panel 84, an opening (not shown) must be provided in the member 86 for access to the assembly. Alternatively, the assembly 10 may be installed from the front of the panel 84 through a cutout 85, due to the thin profile of the assembly 10, as shown in FIG. 14. With such front installation, the support member 86 can be secured to the back of panel 84 before the assembly 10 is installed, and no access opening is necessary in the member 86. The assembly is slid through the hole 85, and then moved rearward to align holes 115 and 92 for receipt of a threaded fastener 90C and 90D, as described above.

Figure 3:
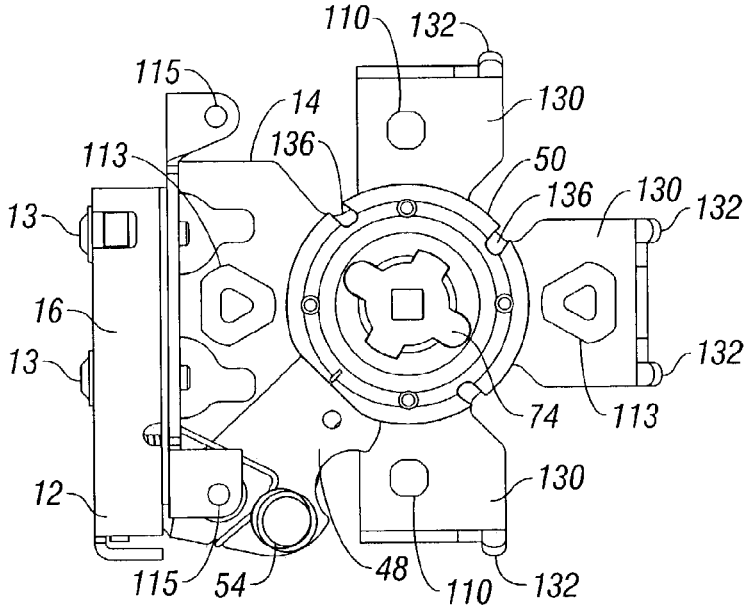
FIG. 3 is a plan view from one side of the assembly.
Figure 8:
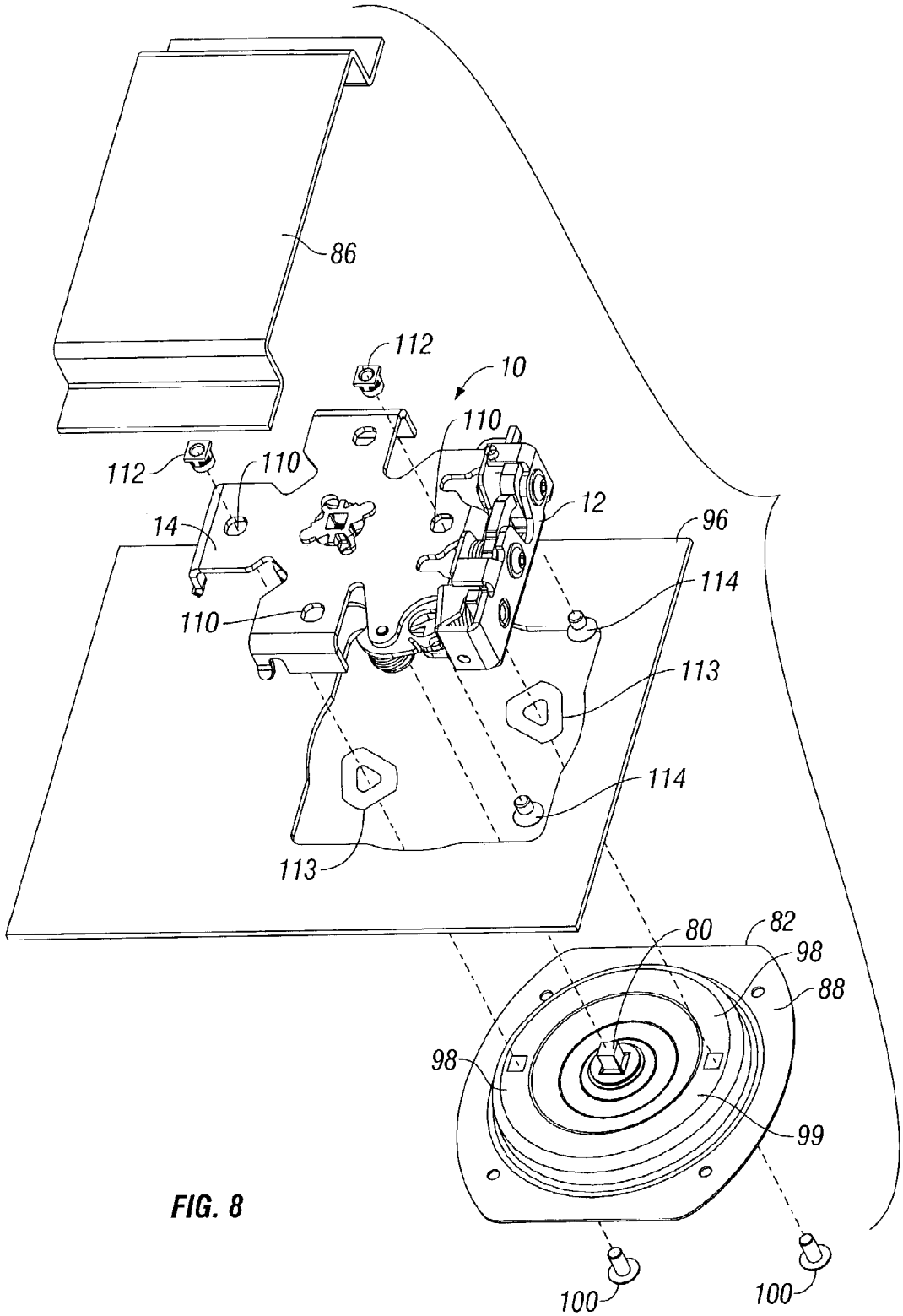
FIG. 8 is an exploded perspective view similar to FIG. 5, however with the mounting bolts extending through the pan of the door handle.
Figure 9:
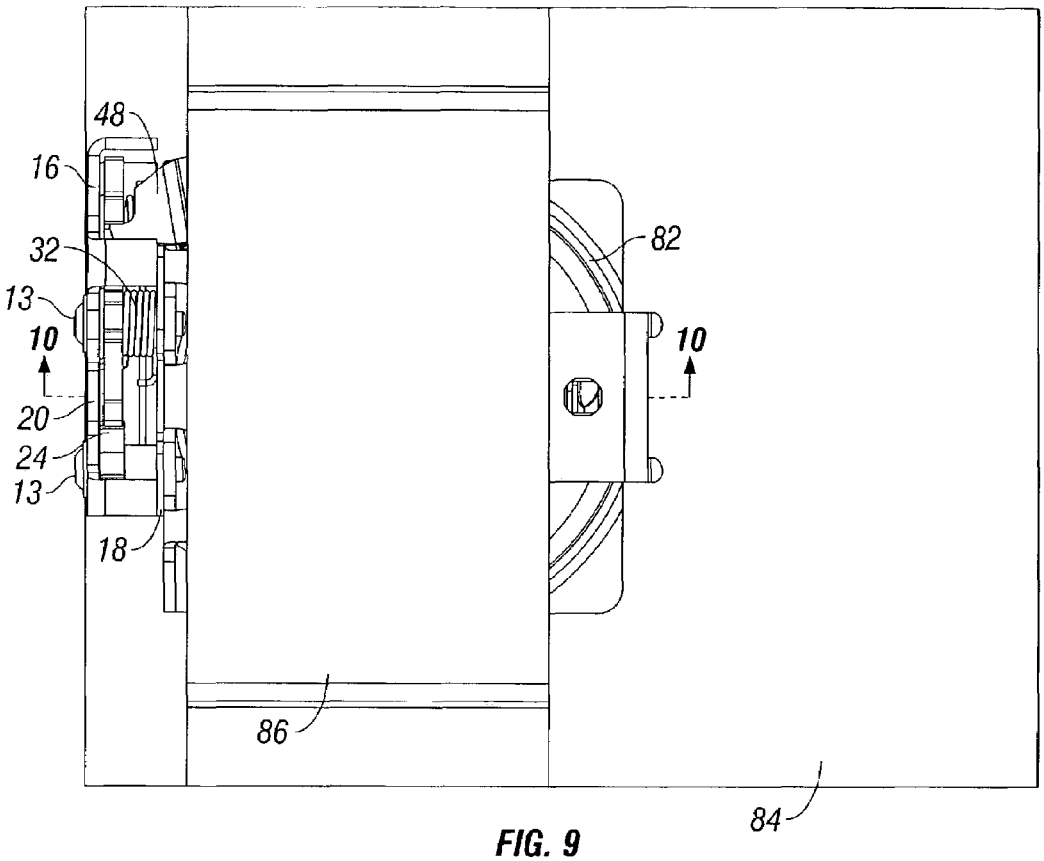
FIG. 9 is a plan view of the assembled components of FIG. 8.
Figure 10:
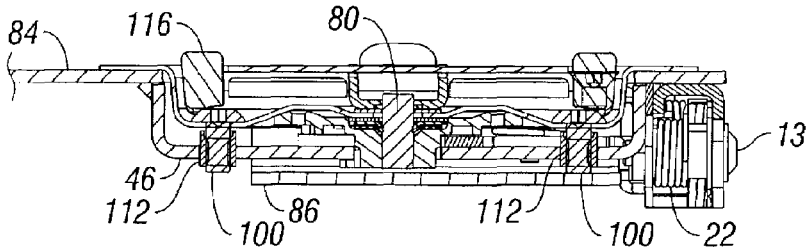
FIG. 10 is a sectional view through lines 10—10 of FIG. 9.

FIGS. 8–10 show an alternative installation of the assembly 10 on the door panel 96. In this arrangement, bolts, such as carriage bolts, machine screws, or cap screws extend through holes (preferably square) 98 in the recessed pan 99 of the handle assembly 82, and then through holes 110 in the plate 46, for retention by nuts 112. As best seen in FIG. 3, the holes 110 preferably have flat sides and rounded corners. When used with carriage bolts, the nuts 112 may be designed with a round shank profile to turn in holes 110 for threading on to the carriage bolts. When used with machine or cap screws, the nuts 112 may be designed with a shank profile matching that of holes 110 to prevent the rotation of the nuts 112 while the machine or cap screws are threaded into the nuts 112. Various means may be used to retain the nuts 112 with the assembly 10 until assembly in the door is completed. These means may include, but are not limited to, a press fit or adhesive (if cap or machine screws are used), or retaining with a clip or plastic retainer 113 into an undercut 117 on the shanks of the nuts 112. The length or thickness of the nuts 112 may be varied, so as to accommodate door panels having different thicknesses, and without the use of separate spacers. Optional locator fasteners 114 may be provided in the door panel 84, as shown in FIG. 8. The locator fasteners 114 are adapted to extend through threaded holes 115 in the plate 46 so as to preclude rotation of the assembly 10 relative to the door panel 84.

In use, when the handle 116 of the handle assembly 82 is turned in a clockwise direction, the drive shaft 80 turns the drive washer 74 and release cam 50 in a clockwise direction, such that a cam lobe 126 on the rear face 66 of the release cam 50 engages a lobe 128 on the lever 48, so as to cause the lever 48 to pivot to the release position. As the lever 48 pivots to the release position, a tab 122 on the end of the lever 48 engages a leg 124 on the catch 22, such that the catch 22 pivots from the locked position engaging the rotor 20 to a disengaged unlocked position such that the rotor 20 is free to pivot to the unlatched position so that the door can be opened.

Similarly, when the handle 116 is pivoted in the counterclockwise direction, a cam lobe 118 on the release cam 50 engages a lobe 120 on the trip lever 48. The resulting interaction between the trip lever 48, the catch 22, and the rotor 20 is the same as described above, such that the rotor 20 is released over the door. An equivalent amount of rotation of the handle 116 in either the clockwise or the counterclockwise directions causes release of the rotor 20.

The bracket 14 includes one or more legs 130 with upturned ends. The end of each leg 130 includes a longer tab or projection which extends slightly beyond the edge of the upturned ends. The function of the projections 132 is to frictionally engage the door panel 84 when the assembly 10 is installed between the door panel 84 and the door support 86, thereby inhibiting the rotation of the assembly 10 relative to the door panel 84. To provide further assurance against rotational movement of the assembly 10, the catch axle 28 may be provided with internal threads adapted to receive a bolt (not shown) extending through a door edge (not shown) perpendicular to the door panel 84.

The simple design of the bracket assembly 14, with relatively few components, allows the components of the bracket 14 to be assembled with a single machine operation to attach rivet 52 to the bracket plate 46.

When the door handle assembly 82 is mounted through the pan 99, as opposed to the flange 88, the open design of the bracket 14 minimizes the likelihood of binding due to deflection arising from excessive mounting torque.

Figure 11:
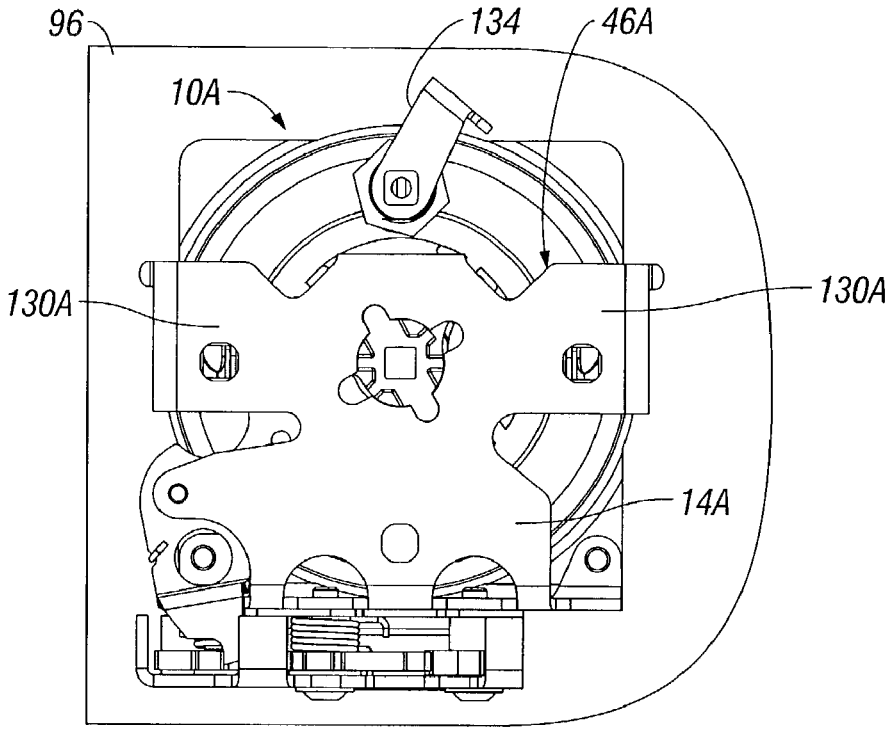
FIG. 11 is a view of an alternative embodiment used with a locking door handle, with the locking cam shown in an unlocked position.
Figure 12:
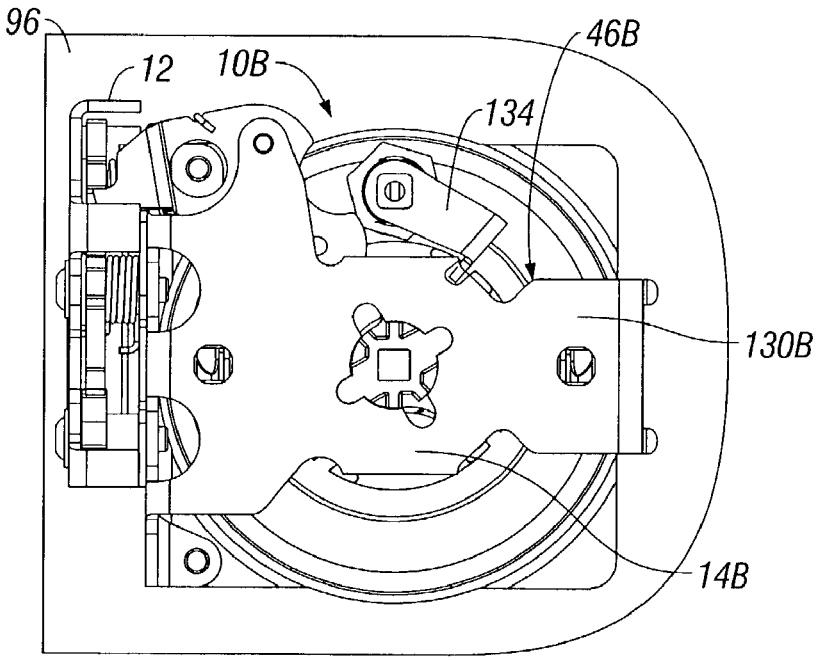
FIG. 12 is a view of a further alternative embodiment used with a locking door handle, with the locking cam shown in a locked position.
Figure 13:
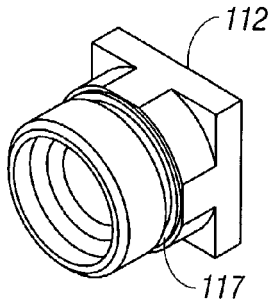
FIG. 13 is an enlarged perspective view of a fixed nut according to the present invention.

FIGS. 6–10 show the bracket and latch assembly 10 in use on a non-locking door handle. FIGS. 11 and 12 show alternative embodiments of assemblies 10A and 10B, respectively, for use with locking door handles. More particularly, in FIG. 11, the assembly 10A includes a modified bracket plate 46A having only two legs 130A. A lock cam 134 is provided on the handle assembly 182 and is adapted to engage one of the slots 136 in the release cam 50 so as to prevent rotation of the cam to unlock the rotor 20 of the latch assembly 12.

Similarly, in FIG. 12, the bracket plate 46B includes a single leg 130B to accommodate the lock cam 134. The lock cam 134 is controlled by a conventional key cylinder (not shown) to move the cam 134 between the locked position engaging the slots 136 in the cam 50 and the unlocked position wherein the locked cam 134 is disengaged from the release cam 50.

It is understood that the bracket and latch assemblies 10, 10A and 10B can be installed in various orientations to the door panel 96. More particularly, the latch 12 can be positioned at the bottom, top or either side to accommodate door panels which are hinged on different edges.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A door handle bracket and latch assembly, comprising:

a latch including a rotor and a catch adapted to move between latched and unlatched positions;

a bracket subassembly including:

a mounting plate secured directly to the latch and being mountable to a door panel;

a cam mounted directly on the mounting plate and being actuable by a door handle; and a trip lever mounted directly on the mounting plate and being driven by the cam to trip the catch to release the latch when the cam is actuated;

the bracket subassembly being assembled with a single rivet; and the cam being mounted to the bracket subassembly without the use of additional, separate fasteners.

2. The assembly of claim 1 wherein the bracket subassembly has an open design wherein the cam is enclosed only on one side.

3. The assembly of claim 1 wherein the cam is made of a plastic material to reduce the coefficiency of friction between the cam and the trip lever.

4. The assembly of claim 1 wherein the bracket subassembly has at least one leg with a turned out end adapted to engage a door panel to prevent rotation of the assembly.

5. The assembly of claim 1 wherein the cam is one piece with a cam lobe engaging the trip lever.

6. The assembly of claim 1 further comprising a nut selected from a group of nuts each having a varying length so as to mount the assembly in door panels having varying thicknesses.

7. The assembly of claim 1 wherein the bracket subassembly has a keyed opening and the cam has retention tabs, whereby the tabs are inserted through the opening and the cam is rotated such that the tabs retain the cam on the bracket.

8. The assembly of claim 1 wherein the bracket subassembly has a plurality of mounting holes adapted to receive a fastener whereby the assembly is mountable through both a flange and a recessed pan of the door handle.

9. The assembly of claim 1 wherein the bracket subassembly has a plurality of mounting holes adapted to receive a fastener whereby the assembly is mountable in various orientations on the door panel.

10. The assembly of claim 1 further comprising a drive washer on the cam adapted to receive a drive shaft of the door handle.

11. The assembly of claim 1 wherein the cam is actuatable in both the clockwise and counterclockwise directions.

12. The assembly of claim 1 further including a nut having a shaft extending through the mounting plate for mounting the assembly to a door panel.

13. The assembly of claim 12 wherein the nut is fixed against rotation.

14. The assembly of claim 12 wherein the nut shaft has a groove, and the mounting plate has a retainer adapted to engage the nut groove to retain the nut with the assembly prior to installation of the assembly in a door panel.

15. A door handle bracket and latch assembly, comprising:

a latch including a rotor and a catch adapted to move between latched and unlatched positions;

a bracket subassembly including:

a mounting plate secured directly to the latch and being mountable to a door panel;

a cam mounted directly on the mounting plate and being actuable by a door handle; and a trip lever mounted directly on the mounting bracket and being driven by the cam to trip the catch to release the latch when the cam is actuated;

the bracket subassembly having an open design wherein the cam is enclosed only on one side; and a drive washer on the cam adapted to receive a drive shaft of the door handle.

16. The assembly of claim 15 wherein the bracket subassembly is assembled with only one rivet.

17. The assembly of claim 15 wherein the cam is made of a plastic material to reduce the coefficiency of friction between the cam and the trip lever.

18. The assembly of claim 15 wherein the bracket has at least one leg with a turned out end adapted to engage a door panel to prevent rotation of the assembly.

19. The assembly of claim 15 wherein the cam is one piece with a cam lobe engaging the trip lever.

20. The assembly of claim 15 further comprising a nut selected from a group of nuts each having a varying length so as to mount the assembly in door panels having varying thicknesses.

21. The assembly of claim 15 wherein the cam is mounted to the bracket without the use of fasteners.

22. The assembly of claim 15 wherein the bracket subassembly has a keyed opening and the cam has retention tabs, whereby the tabs are inserted through the opening and the cam is rotated such that the tabs retain the cam on the bracket.

23. The assembly of claim 15 wherein the bracket subassembly has a plurality of mounting holes adapted to receive a fastener whereby the assembly is mountable through both a flange and a recessed pan of the door handle.

24. The assembly of claim 15 wherein the bracket has a plurality of mounting holes adapted to receive a fastener whereby the assembly is mountable in various orientations on the door panel.

25. The assembly of claim 15 wherein the cam is actuatable in both the clockwise and counterclockwise directions.

26. The assembly of claim 15 further including a nut having a shaft extending through the mounting plate for mounting the assembly to a door panel.

27. The assembly of claim 26 wherein the nut is fixed against rotation.

28. The assembly of claim 26 wherein the nut shaft has a groove, and the mounting plate has a retainer adapted to engage the nut groove to retain the nut with the assembly prior to installation of the assembly in a door panel.

29. A door handle bracket and latch assembly, comprising:
a latch including a rotor and a catch adapted to move between latched and unlatched positions;
a bracket subassembly including:
a mounting bracket secured directly to the latch and being mountable to a door panel;
a cam mounted directly on the mounting bracket; and
a trip lever mounted directly on the mounting bracket and being driven by the cam to trip the catch to release the latch when the cam is actuated;
the assembly installed through a cutout in a hollow door panel and from the front of the door panel, the cutout being smaller than a periphery of the assembly;
the assembly further comprising a nut having a shaft extending through the mounting plate for mounting the assembly to a door panel.

30. The assembly of claim 29 wherein the bracket has a plurality of mounting holes adapted to receive a fastener whereby the assembly is mountable through both a flange and a recessed pan of the door handle.

31. The assembly of claim 29 wherein the bracket subassembly has a plurality of mounting holes adapted to receive a fastener whereby the assembly is mountable in various orientations on the door panel.

32. The assembly of claim 29 wherein the bracket subassembly has an open design wherein the cam is enclosed only on one side.

33. The assembly of claim 29 wherein the cam is made of a plastic material to reduce the coefficiency of friction between the cam and the trip lever.

34. The assembly of claim 29 wherein the bracket subassembly has at least one leg with a turned out end adapted to engage a door panel to prevent rotation of the assembly.

35. The assembly of claim 29 wherein the cam is one piece with a cam surface engaging the trip lever.

36. The assembly of claim 29 further comprising a nut selected from a group of nuts each having a varying length so as to mount the assembly in door panels having varying thicknesses.

37. The assembly of claim 29 wherein the cam is mounted to the bracket subassembly without the use of additional, separate fasteners.

38. The assembly of claim 29 wherein the bracket subassembly has an opening and the cam has retention tabs, whereby the tabs are inserted through the opening and the cam is rotated such that the tabs retain the cam on the bracket.

39. The assembly of claim 29 further comprising a drive washer on the cam adapted to receive a drive shaft of the door handle.

40. The assembly of claim 29 wherein the cam is actuatable in both the clockwise and counterclockwise directions.

41. The assembly of claim 29 wherein the bracket subassembly is assembled with only one rivet.

42. The assembly of claim 29 wherein the nut is fixed against rotation.

43. The assembly of claim 29 wherein the nut shaft has a groove, and the mounting plate has a retainer adapted to engage the nut groove to retain the nut with the assembly prior to installation of the assembly in a door panel.

44. A door handle bracket and latch assembly, comprising:
a latch including a rotor and a catch adapted to move between latched and unlatched positions;
a bracket subassembly including:
a mounting plate secured directly to the latch and being mountable to a door panel;
a cam mounted directly on the mounting plate and being actuable by a door handle; and
a trip lever mounted directly on the mounting plate and being driven by the cam to trip the catch to release the latch when the cam is actuated;
the bracket subassembly being assembled with a single rivet; and
the bracket subassembly having a keyed opening and the cam having retention tabs, whereby the tabs are inserted through the opening and the cam is rotated such that the tabs retain the cam on the bracket.

45. A door handle bracket and latch assembly, comprising:
a latch including a rotor and a catch adapted to move between latched and unlatched positions;
a bracket subassembly including:
a mounting plate secured directly to the latch and being mountable to a door panel;
a cam mounted directly on the mounting plate and being actuable by a door handle; and
a trip lever mounted directly on the mounting plate and being driven by the cam to trip the catch to release the latch when the cam is actuated;
the bracket subassembly being assembled with a single rivet; and
a drive washer on the cam adapted to receive a drive shaft of the door handle.

46. A door handle bracket and latch assembly, comprising:
a latch including a rotor and a catch adapted to move between latched and unlatched positions;
a bracket subassembly including:
a mounting plate secured directly to the latch and being mountable to a door panel;
a cam mounted directly on the mounting plate and being actuable by a door handle; and
a trip lever mounted directly on the mounting plate and being driven by the cam to trip the catch to release the latch when the cam is actuated;
the bracket subassembly being assembled with a single rivet; and
a nut having a shaft extending through the mounting plate for mounting the assembly to a door panel.

47. The assembly of claim 46 wherein the nut is fixed against rotation.

48. The assembly of claim 46 wherein the nut shaft has a groove, and the mounting plate has a retainer adapted to engage the nut groove to retain the nut with the assembly prior to installation of the assembly in a door panel.

49. A door handle bracket and latch assembly, comprising:
a latch including a rotor and a catch adapted to move between latched and unlatched positions;
a bracket subassembly including:
a mounting plate secured directly to the latch and being mountable to a door panel;
a cam mounted directly on the mounting plate and being actuable by a door handle; and
a trip lever mounted directly on the mounting bracket and being driven by the cam to trip the catch to release the latch when the cam is actuated;
the bracket subassembly having an open design wherein the cam is enclosed only on one side; and the cam being mounted to the bracket without the use of additional separate fasteners.

50. A door handle bracket and latch assembly, comprising:

a latch including a rotor and a catch adapted to move between latched and unlatched positions;

a bracket subassembly including:

a mounting plate secured directly to the latch and being mountable to a door panel;

a cam mounted directly on the mounting plate and being actuable by a door handle; and a trip lever mounted directly on the mounting bracket and being driven by the cam to trip the catch to release the latch when the cam is actuated;

the bracket subassembly having an open design wherein the cam is enclosed only on one side; and the bracket subassembly having a keyed opening and the cam having retention tabs, whereby the tabs are inserted through the opening and the cam is rotated such that the tabs retain the cam on the bracket.

51. A door handle bracket and latch assembly, comprising:

a latch including a rotor and a catch adapted to move between latched and unlatched positions;

a bracket subassembly including:

a mounting plate secured directly to the latch and being mountable to a door panel;

a cam mounted directly on the mounting plate and being actuable by a door handle; and a trip lever mounted directly on the mounting bracket and being driven by the cam to trip the catch to release the latch when the cam is actuated;

the bracket subassembly having an open design wherein the cam is enclosed only on one side; and a nut having a shaft extending through the mounting plate for mounting the assembly to a door panel.

52. The assembly of claim 51 wherein the nut is fixed against rotation.

53. The assembly of claim 51 wherein the nut shaft has a groove, and the mounting plate has a retainer adapted to engage the nut groove to retain the nut with the assembly prior to installation of the assembly in a door panel.

54. A door handle bracket and latch assembly, comprising:

a latch including a rotor and a catch adapted to move between latched and unlatched positions;

a bracket subassembly including:

a mounting bracket secured directly to the latch and being mountable to a door panel;

a cam mounted directly on the mounting bracket; and a trip lever mounted directly on the mounting bracket and being driven by the cam to trip the catch to release the latch when the cam is actuated;

the assembly installed through a cutout in a hollow door panel and from the front of the door panel, the cutout being smaller tan a periphery of the assembly, the assembly further comprising the cam being mounted to the bracket subassembly without the use of additional, separate fasteners.

55. A door handle bracket and latch assembly, comprising:

a latch including a rotor and a catch adapted to move between latched and unlatched positions;

a bracket subassembly including:

a mounting bracket secured directly to the latch and being mountable to a door panel;

a cam mounted directly on the mounting bracket; and a trip lever mounted directly on the mounting bracket and being driven by the cam to trip the catch to release the latch when the cam is actuated;

the assembly installed through a cutout in a hollow door panel and from the front of the door panel, the cutout being smaller than a periphery of the assembly;

the assembly further comprising the bracket subassembly having an opening and the cam having retention tabs, whereby the tabs are inserted through the opening and the cam is rotated such that the tabs retain the cam on the bracket.

56. A door handle bracket and latch assembly, comprising:

a latch including a rotor and a catch adapted to move between latched and unlatched positions;

a bracket subassembly including:

a mounting bracket secured directly to the latch and being mountable to a door panel;

a cam mounted directly on the mounting bracket; and a trip lever mounted directly on the mounting bracket and being driven by the cam to trip the catch to release the latch when the cam is actuated;

the assembly installed through a cutout in a hollow door panel and from the front of the door panel, the cutout being smaller than a periphery of the assembly;

the assembly further comprising a drive washer on the cam adapted to receive a drive shaft of the door handle.

* * * * *